US011008849B2

(12) United States Patent
Sherlock

(10) Patent No.: US 11,008,849 B2
(45) Date of Patent: May 18, 2021

(54) GRADE MANAGEMENT SYSTEM FOR AN IMPLEMENT

(71) Applicant: Deere & Company, Moline, IL (US)

(72) Inventor: Lance R. Sherlock, Asbury, IA (US)

(73) Assignee: DEERE & COMPANY, Moline, IL (US)

( * ) Notice: Subject to any disclaimer, the term of this patent is extended or adjusted under 35 U.S.C. 154(b) by 162 days.

(21) Appl. No.: 16/122,274

(22) Filed: Sep. 5, 2018

(65) Prior Publication Data

US 2020/0072032 A1 Mar. 5, 2020

(51) Int. Cl.

| | |
|---|---|
| ***E21B 44/00*** | (2006.01) |
| ***E21B 7/02*** | (2006.01) |
| ***E21B 12/00*** | (2006.01) |
| ***E21B 47/04*** | (2012.01) |
| ***E21B 10/44*** | (2006.01) |

(52) U.S. Cl.

CPC ..... *E21B 44/00* (2013.01); *E21B 7/027* (2013.01); *E21B 10/44* (2013.01); *E21B 12/00* (2013.01); *E21B 47/04* (2013.01)

(58) Field of Classification Search

CPC ..... E21B 7/022; E21B 44/00; E21B 44/005

See application file for complete search history.

(56) References Cited

U.S. PATENT DOCUMENTS

| | | | | |
|---|---|---|---|---|
| 2003/0066662 | A1* | 4/2003 | Rynard | E21B 27/00 172/25 |
| 2011/0147084 | A1* | 6/2011 | Sinnerstad | E21B 44/06 175/56 |
| 2012/0163921 | A1* | 6/2012 | Ditillo | E21B 44/00 405/232 |
| 2013/0048378 | A1* | 2/2013 | Pirinen | E21B 19/167 175/24 |
| 2013/0197737 | A1* | 8/2013 | Malayappalayam Shanmugam | E02F 3/46 701/29.1 |
| 2016/0123146 | A1* | 5/2016 | Makela | G05D 1/024 701/50 |
| 2016/0305234 | A1* | 10/2016 | Korherr | E21B 47/09 |
| 2017/0009530 | A1* | 1/2017 | Homma | E21B 21/015 |
| 2017/0298722 | A1* | 10/2017 | Pettapiece | E21B 44/00 |
| 2018/0216407 | A1* | 8/2018 | Spreitzer | E21B 44/00 |

* cited by examiner

*Primary Examiner* — Andrew M Tecco
*Assistant Examiner* — Eyamindae C Jallow
(74) *Attorney, Agent, or Firm* — Michael Best & Friedrich LLP

(57) ABSTRACT

A grade management system configured to control a depth of a dig includes a vehicle including an arm assembly coupled to an implement, the implement configured to dig into a surface, and an implement position sensor coupled to the arm assembly, the implement position sensor configured to detect a position of the implement relative to the vehicle, wherein in response to digging into the surface with the implement, detecting the position of the implement relative to the vehicle and determining whether any portion of the implement reaches a targeted depth into the surface.

19 Claims, 5 Drawing Sheets

GRADE MANAGEMENT SYSTEM FOR AN IMPLEMENT

FIELD

The present disclosure relates to a grade management system for a construction vehicle. More specifically, the present disclosure relates to a system that provides directional guidance for an implement associated with a construction vehicle, the directional guidance including at least a depth (or Z-direction) for controlled or guided digging.

SUMMARY

In one aspect, the disclosure provides a grade management system configured to control a depth of a dig that includes a vehicle including an arm assembly coupled to an implement, the implement configured to dig into a surface, and an implement position sensor coupled to the arm assembly, the implement position sensor configured to detect a position of the implement relative to the vehicle, wherein in response to digging into the surface with the implement, detecting the position of the implement relative to the vehicle and determining whether any portion of the implement reaches a targeted depth into the surface.

In another aspect, the disclosure provides a method of controlling a depth of a dig in a surface with a vehicle that includes selecting a target depth of the dig into the surface, detecting a position of an implement relative to the vehicle, using the detected position of the implement relative to the vehicle to assign an initial implement position, determining the distance from the initial implement position to the ground, determining a final implement position based on at least a position of the implement relative to the vehicle upon reaching the target depth of the dig into the surface, initiating digging with the implement, monitoring the position of the implement relative to the vehicle during digging, and determining whether the detected position of the implement relative to the vehicle corresponds to the final implement position.

Other aspects of the disclosure will become apparent by consideration of the detailed description and accompanying drawings.

Before embodiments of the disclosure are explained in detail, it is to be understood that the disclosure is not limited in its application to the details of construction and the arrangement of components set forth in the following description or illustrated in the accompanying drawings. The disclosure is capable of supporting other embodiments and of being practiced or of being carried out in various ways.

DETAILED DESCRIPTION

The application refers to the terms "construction vehicle" or "vehicle," but illustrates a compact track loader. It should be appreciated that the terms "construction vehicle" and "vehicle" can include a compact track loader or a skid steer (or skid loader, or skid-steer loader). In addition, the "construction vehicle" and "vehicle" can include any other suitable vehicle or equipment that can be configured to operate an implement that digs, drills, trenches, or otherwise moves or removes material and it is advantageous to control the depth of the implement and/or the depth of a space being created. As a non-limiting example, the "construction vehicle" or "vehicle" can include a backhoe with a bucket or other suitable implement for digging, drilling, trenching or otherwise moving material. As another non-limiting example, the "construction vehicle" or "vehicle" can include an agricultural tractor with a trencher or other suitable implement for digging, drilling, trenching or otherwise moving material. In some embodiments, the systems disclosed herein are suited for application on or use in conjunction with equipment having one or more implements used to dig, drill, trench, or otherwise move or remove material.

The application also refers to the term "implement," but illustrates the implement as an auger attachment for digging holes. It should be appreciated that the term "implement" can include an auger or auger attachment, but is not limited to the auger or auger attachment. The term "implement" can include a bucket (or bucket attachment), a trencher (or trencher attachment), or any other suitable tool or device configured to dig, drill, trench, or otherwise move or remove material. The "implement" can be removable or can be permanently attached to the vehicle. Further, the "implement" can include any suitable tool or device usable with the system disclosed herein to allow for a precise location of at least one hole, and/or a control of a depth of a dig of a hole, trench, hollowed out area, or other recess as described herein.

The term calculating (or calculate and calculated), as used herein, is used with reference to calculations performed by the disclosed system. The term includes calculating, determining, and estimating.

Figure 1:
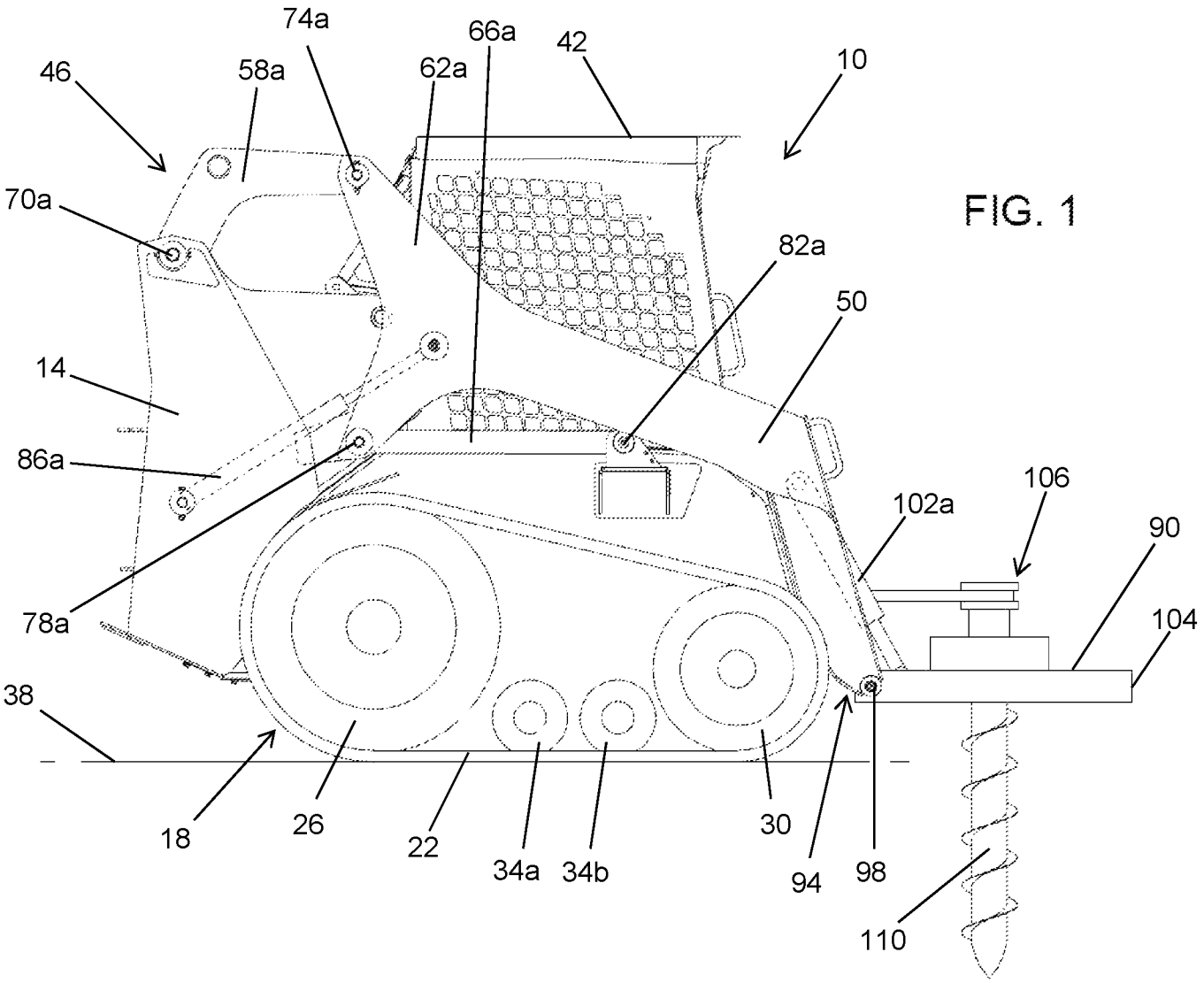
FIG. 1 is a first side view of an example of a construction vehicle including an implement, with portions of several components that are hidden from view being shown in broken lines.
Figure 2:
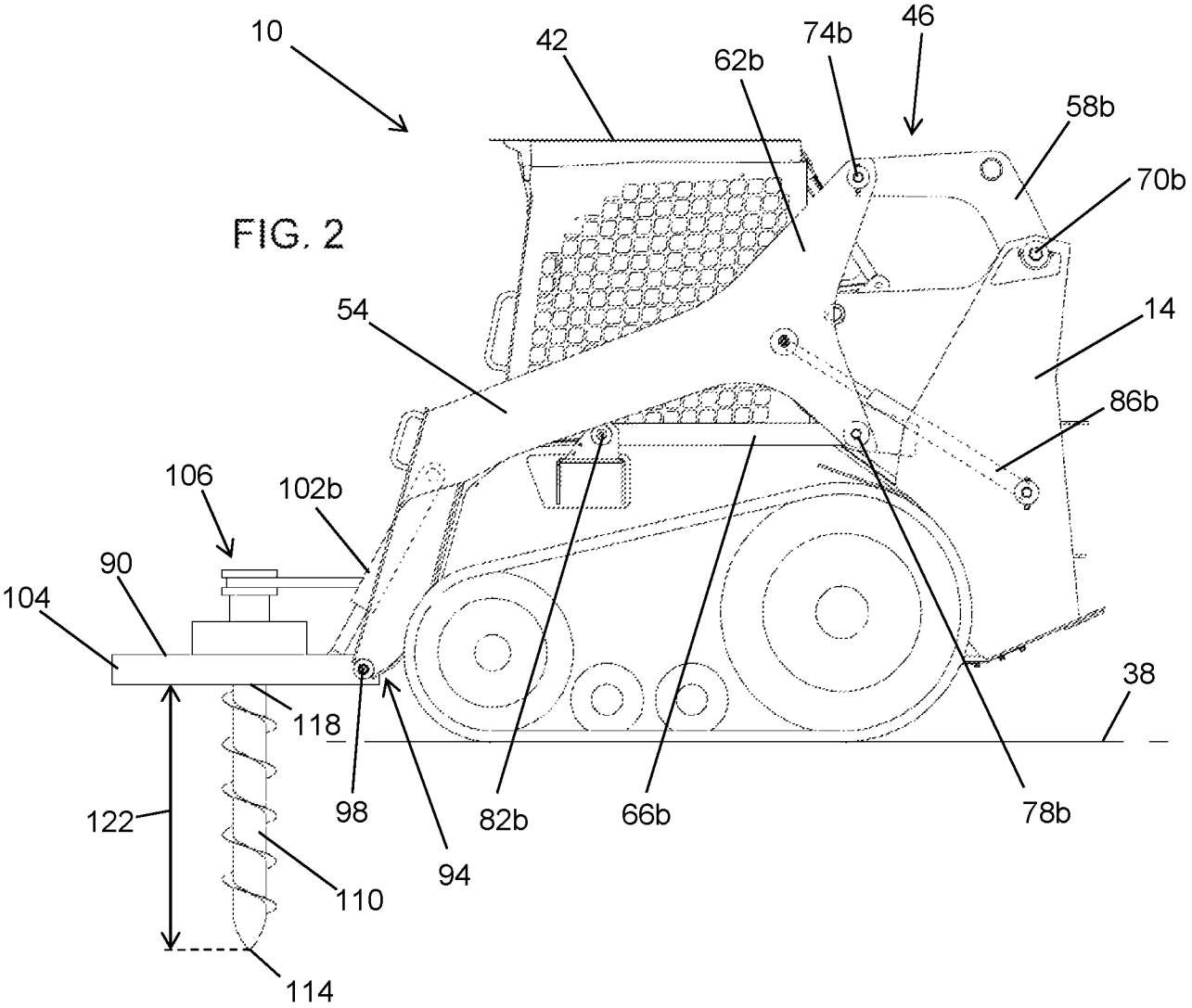
FIG. 2 is a second, opposite side view of the construction vehicle of FIG. 1, with portions of several components that are hidden from view being shown in broken lines.

With reference now to the figures, FIGS. 1-2 illustrate an embodiment of a construction vehicle 10 (or vehicle 10), illustrated as a compact track loader. With specific reference to FIG. 1, the vehicle 10 includes a frame 14. A wheel assembly 18 is coupled to the frame 14. The wheel assembly 18 is illustrated as a continuous track. The wheel assembly 18 includes a continuous band of treads 22 (or continuous track 22 or track plates 22) that is driven by drive wheels 26, 30. The wheel assembly 18 also includes a plurality of road wheels 34*a, b* (or bogie wheels 34*a, b*). Thought not illustrated, the wheel assembly 18 can also include one or more idler wheels (or sprocket wheels) that can assist with tensioning and/or guiding the continuous track 22. In other embodiments, the wheel assembly 18 can include a plurality of wheels, such as on a skid steer. It should be appreciated that the wheel assembly 18 shown in FIG. 1 includes a mirror image of the components on the opposite side of the vehicle 10 (illustrated, but not numbered in FIG. 2).

An engine (not shown) is coupled to the frame 12, and is operable to move the vehicle 10. More specifically, the engine is configured to drive the wheel assembly 18 (e.g., drive the drive wheels 26, 30, etc.). This facilitates movement of the vehicle 10 along a surface 38, such as ground, terrain, or any other topography upon which the vehicle 10 traverses. An operator cab 42 is coupled to the frame 14. The operator cab 42 defines a space suitable to receive at least one individual to operate the vehicle 10.

With reference to FIGS. 1-2, the vehicle 10 includes an arm assembly 46. The arm assembly 46 includes a first boom arm 50 (shown in FIG. 1) and a second boom arm 54 (shown in FIG. 2). The first boom arm 50 is a mirror image of the second boom arm 54. Each boom arm 50, 54 includes a multi-bar linkage to facilitate movement of the boom arms 50, 54. More specifically, each boom arm 50, 54 includes a first linkage 58*a*, 58*b*, a second linkage 62*a*, 62*b*, and a third linkage 66*a*, 66*b*. The first linkage 58*a*, 58*b* is coupled to the frame 14 at one end by a first pin 70*a*, 70*b*, and is coupled to the second linkage 62*a*, 62*b* at an opposite end by a second pin 74*a*, 74*b*. The second linkage 62*a*, 62*b* is coupled to one end of the third linkage 66*a*, 66*b* by a third pin 78*a*, 78*b*. A second end of the third linkage 66*a*, 66*b*, opposite the first end, is coupled to the frame 14 by a fourth pin 82*a*, 82*b*. A first cylinder 86*a*, 86*b* is coupled at one end to the frame 14, and at the opposite end to the second linkage 62*a*, 62*b*. The first cylinder 86*a*, 86*b* is a hydraulic cylinder 86. Each pin 70*a*, 70*b*, 74*a*, 74*b*, 78*a*, 78*b*, 82*a*, 82*b* defines an axis of rotation to facilitate upward and downward movement of each respective boom arm 50, 54 during corresponding extension or retraction of the first cylinder 86*a*, 86*b*. While the illustrated embodiment of the arm assembly 46 includes a plurality of linkages, and more specifically three linkages 58*a*, 58*b*, 62*a*, 62*b*, 66*a*, 66*b* on each side, in other embodiments the arm assembly 46 can include any suitable number of linkages provided in any suitable orientation to raise and/or lower the boom arms 50, 54. Further, in other embodiments, the arm assembly 46 can include a plurality of cylinders 86*a*, 86*b* on each side to facilitate movement of the arm assembly 46. In addition, in other embodiments, the arm assembly 46 can include a single boom arm defined by a plurality of sequential linkages that can extend and/or retract (e.g., such as an excavator, a backhoe, etc.).

An implement 90 is coupled to an implement end 94 of the arm assembly 46. The implement 90 is coupled to the arm assembly 46, and more specifically the boom arms 50, 54, at a fifth pin 98. A second cylinder 102*a*, 102*b* extends between each boom arm 50, 54 and the implement 90, facilitating movement of the implement 90 relative to the arm assembly 46 (e.g., the implement 90 can pivot about a pivot axis defined by the fifth pin 98). In the illustrated embodiment, the implement 90 is illustrated as an auger attachment 90. The auger attachment 90 includes a mount plate 104 (or a control surface 104). A drive assembly 106 is coupled to the mount plate 104. The drive assembly 106 is configured to rotate an auger 110. The drive assembly 106 is shown as a belt driven system to drive the auger 110. In other embodiments, the drive assembly 106 can include a standalone motor or any other suitable drive that is configured to rotate the auger 110. The auger 110 extends (or projects away) from the mount plate 104. The mount plate 104 includes a mounting portion that provides an attachment position (not shown) to couple an end of each second cylinder 102*a*, 102*b* to the auger attachment 90. The mount plate 104 also defines a pin receiving aperture (not shown) that is configured to receive the fifth pin 98, facilitating coupling of the auger attachment 90 to the arm assembly 46 (and more specifically to the boom arms 50, 54).

With reference to FIG. 2, the auger 110 includes an auger tip 114 (or first end 114) that is opposite an auger base 118 (or second end 118). The auger base 118 is the portion of the auger 110 that contacts the base plate 104 (or the portion of the auger 110 that is aligned with an auger side of the mount plate 104). The distance between the auger tip 114 and the auger base 118 defines an auger length 122. Stated another way, the auger length 122 is the length of the auger 110 that projects from mount plate 104. The auger length 122 can be any suitable length, and can change depending on the associated auger 110 that is attached to the vehicle 10.

Figure 3:
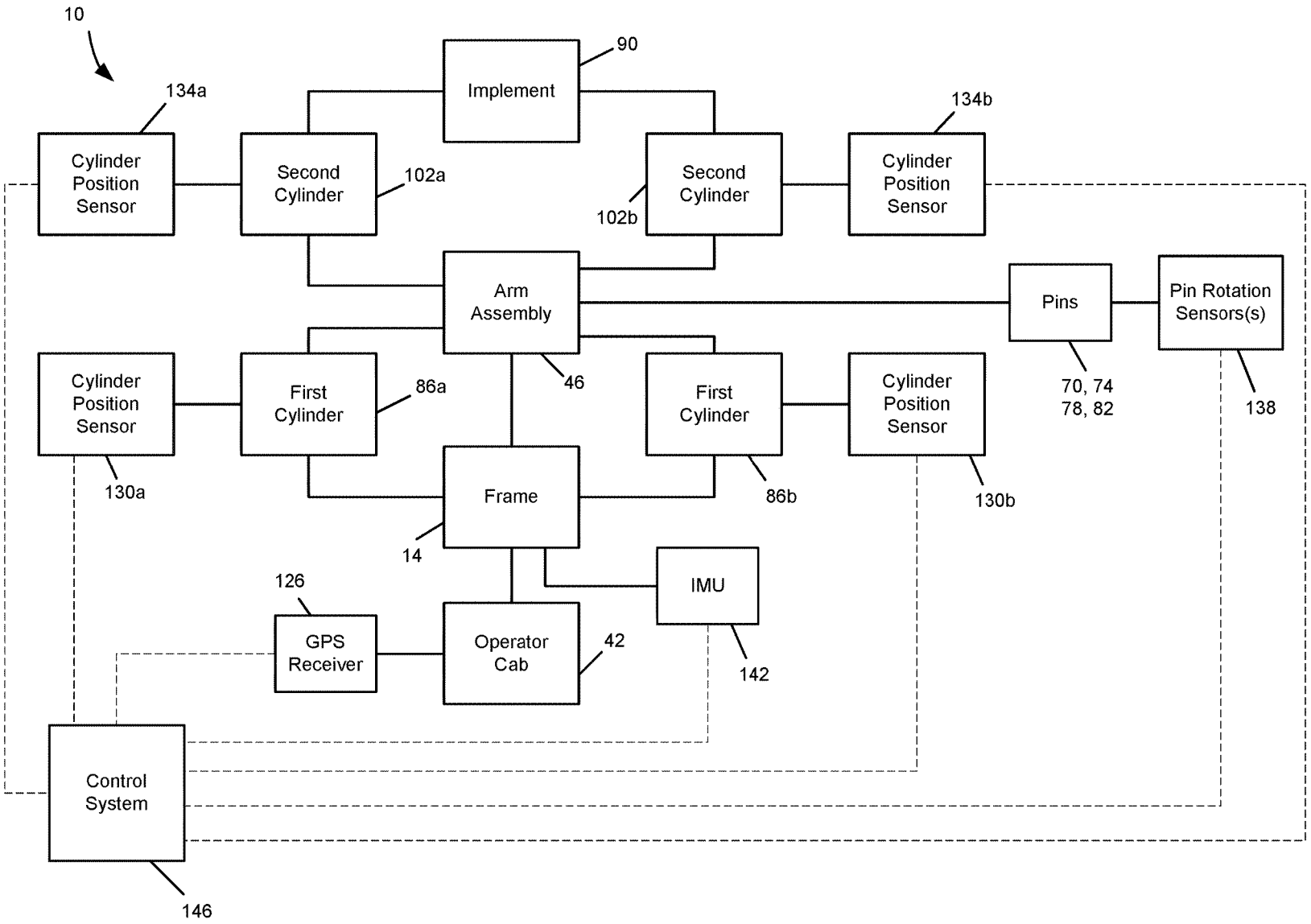
FIG. 3 is a schematic layout of a portion of the construction vehicle of FIG. 1 to illustrate sensor positioning for data acquisition during operation of the vehicle.

FIG. 3 illustrates a schematic view of an embodiment of a sensor arrangement for the vehicle 10. The sensor arrangement provides sensor data that is utilized by a grade management system 200 (or depth control system 200) to identify a precise position for digging, calculate an orientation of the implement 90 relative to the surface 38 (or ground 38), and/or control a depth of digging to limit over digging.

Figure 4:
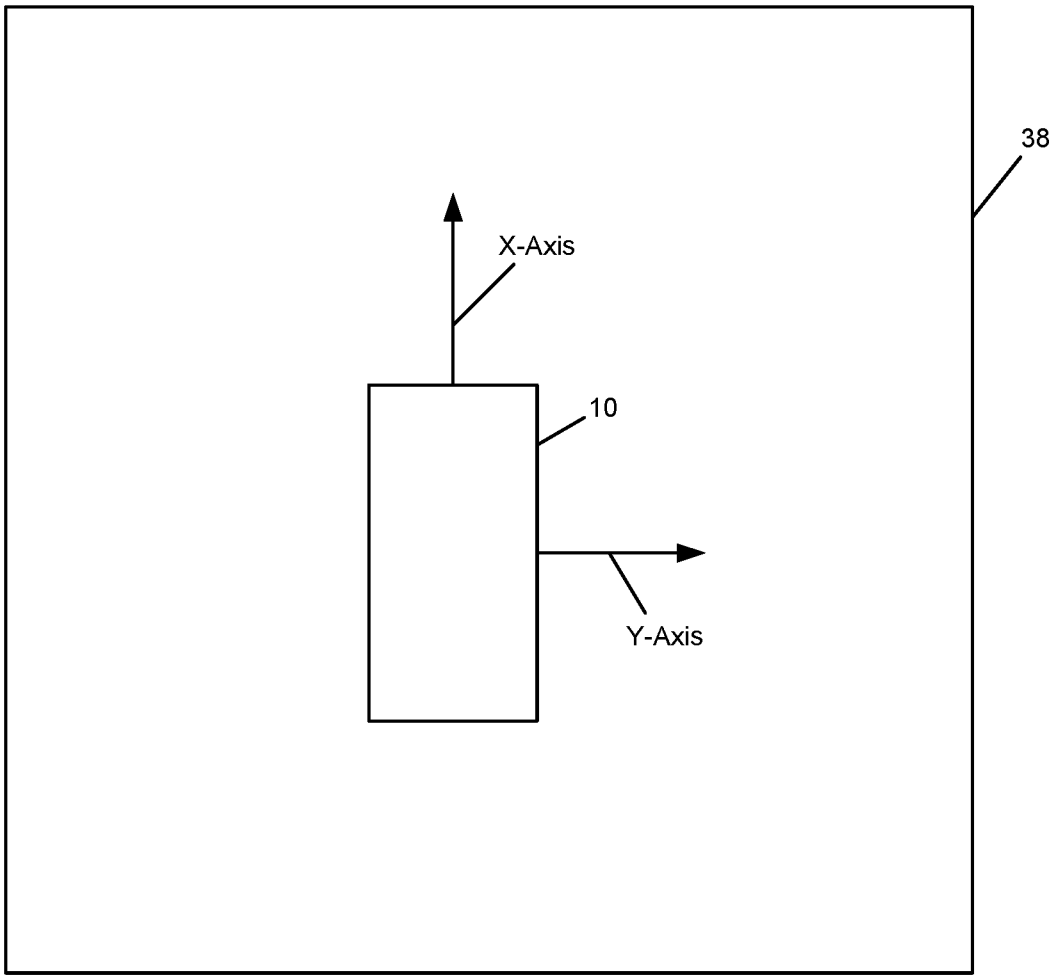
FIG. 4 is an overhead schematic layout of the construction vehicle of FIG. 1 to illustrate the axes along which the position of the vehicle is measured relative to the ground on which the vehicle operates.

The vehicle 10 includes a vehicle location sensor 126, illustrated as a Global Positioning System (GPS) receiver 126. In FIG. 4, the vehicle GPS receiver 126 is illustrated as positioned on the operator cab 42. In other embodiments, the vehicle GPS receiver 126 can be positioned on any suitable location of the vehicle 10 (e.g., on the frame 14, on the arm assembly 46, etc.). The GPS receiver 126 can provide real time location data (or location information) relating to the position of the vehicle 10.

The vehicle 10 also includes an implement position sensor assembly that is configured to calculate a position (or orientation or attitude) of the implement 90 relative to the vehicle 10. The implement position sensor assembly can include one or more of one or more cylinder position sensors 130, 134, one or more pin rotation sensors 138, and/or at least one inertial measurement unit 142. The implement position sensor assembly together can calculate an orientation (or attitude) of the vehicle 10 relative to the surface 38 (or ground 38), and an associated position (or orientation or attitude) of the implement 90 relative to the vehicle 10. In other embodiments, the implement position sensor assembly can calculate the orientation (or attitude) of the implement 90 relative to the surface 38 (or ground 38) independent of the vehicle 10. While the illustrated implement position sensor assembly includes a plurality of cylinder position sensors 130, 134, a plurality of pin rotation sensors 138, and an inertial measurement unit 142, in other embodiments, the implement position sensor assembly can include any combination of sensors suitable to calculate the position (or orientation or attitude) of the implement 90 relative to the surface 38 (or ground 38).

With reference to FIG. 3, one or more cylinder position sensors 130, 134 can be associated with each cylinder 86, 102 to detect a position of the associated cylinder 86, 102. For example, the sensors 130, 134 can be a pressure sensor to detect a pressure in the cylinder, which correlates to a cylinder extension (or contraction) position. As another example, the sensors 130, 134 can be a length detection sensor that detects a length of the cylinder that is extended (or contracted). In other embodiments, the sensors 130, 134 can be any sensor suitable to detect a position of the cylinder to facilitate calculating a position of the implement 90 through the position of the arm assembly 46. As shown in FIG. 4, the first cylinders 86*a*, 86*b* each include an associated first cylinder position sensor 130*a*, 130*b*, and the second cylinders 102*a*, 102*b* each include an associated second cylinder position sensor 134*a*, 134*b*. It should be appreciated that each cylinder associated with the arm assembly 46 and/or implement 90 can include an associated sensor 130, 134. In other embodiments, fewer than all of the cylinders associated with the arm assembly 46 and/or implement 90 can include an associated sensor 130, 134. In embodiments where the cylinder position sensors 130, 134 are pressure sensors, the sensors can be used to detect impact of the implement 90 (e.g., the auger 110, etc.) with the surface 38 (or ground 38).

One or more pin rotation sensors 138 can be associated with one or more pins 70, 74, 78, 82 of the arm assembly 46. More specifically, one or more of the pins 70*a*, 70*b*, 74*a*, 74*b*, 78*a*, 78*b*, 82*a*, 82*b* can include the pin rotation sensor 138 to detect rotation of the associated pin 70*a*, 70*b*, 74*a*, 74*b*, 78*a*, 78*b*, 82*a*, 82*b* during movement of the arm assembly 46. The position/rotation of the associated pin(s) 70*a*, 70*b*, 74*a*, 74*b*, 78*a*, 78*b*, 82*a*, 82*b* can be used to facilitate calculating a position of the implement 90 through the position of the arm assembly 46. It should be appreciated that each pin 70*a*, 70*b*, 74*a*, 74*b*, 78*a*, 78*b*, 82*a*, 82*b* can include an associated pin rotation sensor 138, or fewer than all of the pins can include an associated pin rotation sensor 138. Generally, the number of pin rotation sensors 138 integrated into the arm assembly 46 is sufficient to detect a position of the arm assembly 46. As an example, pin rotation sensors 138 can be associated with one set of pins (e.g., pins 70*a*, 74*a*, 78*a*, 82*a*, or pins 70*b*, 74*b*, 78*b*, 82*b*, etc.) to detect the position of the arm assembly 46.

An inertial measurement unit 142 (or IMU 142 or inertial measurement sensor 142) is positioned at a location on the vehicle 10. For example, the inertial measurement unit 142 is positioned on the frame 14. More specifically, the inertial measurement unit 142 can be positioned in an engine compartment to detect an attitude of the vehicle 10 (e.g., a roll, a pitch, a yaw, a position of the vehicle 10 relative to the surface or ground 38, etc.). The inertial measurement unit 142 can detect changes in the position and/or orientation of the attached component. More specifically, each inertial measurement unit 142 can detect changes in (or measures the position and/or orientation of) the attached component along up to three axes: an X-axis or roll, a Y-axis or pitch, and a Z-axis or yaw. The inertial measurement unit 142 can have a sensor associated with each axis that is being measured, such as a gyroscope and/or an accelerometer. The inertial measurement unit 142 provides sensor data associated with the position of the attached component along the measured axes with reference to a reference position. The reference position can include gravity or a preset location of the component being measured (e.g., an orientation on a flat surface/ground 34, etc.). The inertial measurement unit 142 tracks the position of the associated component during operation of the vehicle 10. As shown in FIG. 4, the inertial measurement unit 142 detects at least a roll of the vehicle 10. Stated another way, the inertial measurement unit 142 detects the distance the vehicle rotates around an X-axis. The inertial measurement unit 142 also detects at least a pitch of the vehicle 10. Stated another way, the inertial measurement unit 142 detects the distance the vehicle rotates around a Y-axis, the Y-axis being perpendicular to the X-axis. It should be appreciated that more than one inertial measurement unit 142 can be integrated into the vehicle 10. In addition, the inertial measurement unit 142 can be position at any position on the vehicle 10 suitable to measure the attitude of the vehicle 10 (e.g., a roll, a pitch, a yaw, etc.). It should be appreciated that the attitude of the vehicle 10 is measured in order to calculate an orientation (or attitude) of the implement 90 (e.g., the orientation of the auger 110 relative to the surface/ground 38, etc.). In other embodiments, the inertial measurement unit 142 can be positioned at any position suitable to measure the orientation (or attitude) of the implement 90 relative to the vehicle 10 and/or the surface 38 (or ground 38). For example, the inertial measurement unit 142 can be positioned on a portion of the implement 90.

A control system 146 (or controller 146) can be in communication with the vehicle location sensor 126 (or the GPS receiver 126) and the implement position sensor assembly (e.g., the cylinder position sensors 130, 134, the pin rotation sensors 138, and/or the inertial measurement unit 142). The communication can be any suitable wired or wireless system for communication (e.g., radio, cellular, BLUETOOTH, 802.11 Wireless Networking protocol, etc.), and is illustrated in broken lines. The grade management system 200 can reside on the control system 146 to facilitate operation from the vehicle 10. The control system 146 is also in communication with the operator cab 42 through an operator interface (not shown) to provide information relating to the vehicle location sensor 126, the implement position sensor assembly, and the grade management system 200 to an operator.

Figure 5:
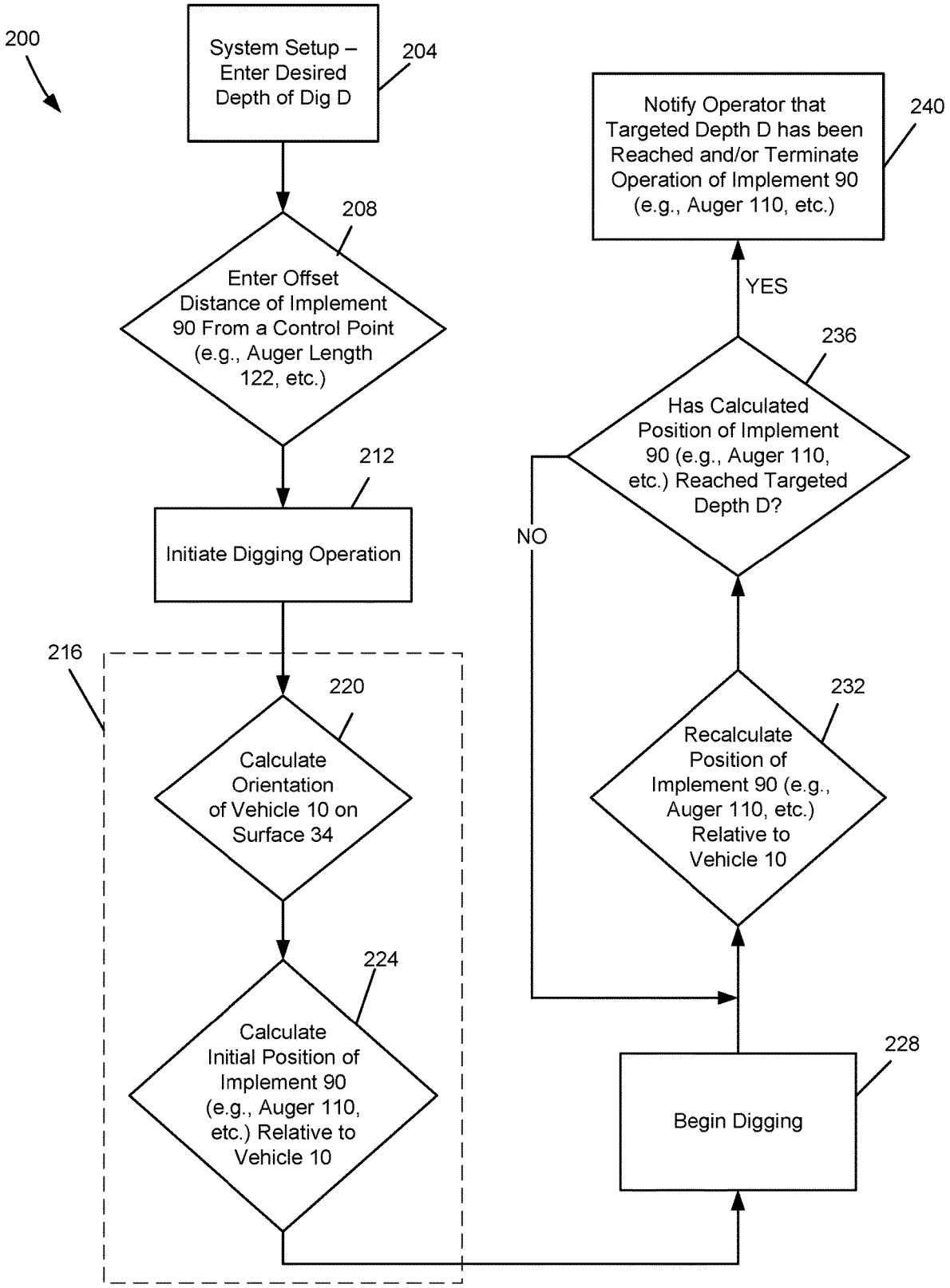
FIG. 5 is a flow diagram of an embodiment of a grade management system to control a depth of a dig by the construction vehicle shown in FIG. 1.

FIG. 5 illustrates an example of the grade management system 200 (or grade management application 200 or depth control system 200) that uses information from the vehicle 10 to calculate an orientation of the implement 90 relative to vehicle 10 (or relative to the surface 38 or the ground 38) and provide operator feedback to control a depth of digging to limit over digging. Further, in some embodiments the system can control a depth of digging to limit over digging. The grade management system 200 includes a series of processing instructions or steps that are depicted in flow diagram form.

Referring to FIG. 5, the process begins at step 204, which is a system setup. During the system setup, a user, operator, or other individual inputs information associated with the vehicle 10 and with the digging operation. At step 204, the operator can enter a target depth of the dig D (or a target depth D into the surface 38 or a final depth D or a desired depth D). As a non-limiting example, the operator may desire to dig a hole four feet deep to receive a post. The operator enters the depth D of the hole as "four feet" at step 204. It should be appreciated that the operator can enter any depth D based on the targeted depth of the digging operation (or digging task).

Next, at step 208 the operator can enter information associated with the implement 90. More specifically, the operator can enter an offset distance for the implement 90 from a control point (position where the implement 90 connects to the arm assembly 46 or other portion of the vehicle 10) to a portion of the implement 90 that contacts the surface 38 (or ground 38). For example, in embodiments where the implement 90 is an auger attachment 90, at step 208 the user enters the auger length 122 associated with the auger 110. As shown in FIG. 2, the auger length 122 is the distance the auger 110 extends from the mount plate 104 (or control surface 104). The mount plate 104 is the control point/control surface for the illustrated auger attachment 90, as the mount plate 104 provides the point of connection to the arm assembly 46 from which the auger attachment 90 is controlled. The auger tip 114 is offset from the mount plate 104 by the distance of the auger length 122. To facilitate depth control for digging, the offset distance from the control point to an end of the implement 90 that contacts the ground 34 is input. In various embodiments, different sized augers 110 can have different auger lengths 122. In addition, different implements 90 can have different offsets that can be entered at step 208. As a non-limiting example, for an implement 90 that is a trencher (or trencher attachment), the length of the trencher that extends away from a surface that couples to the arm assembly 46 can be entered at step 208. This provides an offset from the control surface to the portion of the trencher that engages the ground 38. As another non-limiting example, for an implement 90 that is a bucket (or bucket attachment), the length of the bucket that extends away from a surface that couples to the arm assembly 46 can be entered at step 208. This provides an offset from the control surface to the portion of the bucket that engages the ground 38. It should be appreciated that the information entered at steps 204 and 208 can be entered through a console or operator interface (not shown) positioned in the operator cab 42.

Once setup is complete, the system 200 proceeds to step 212. At step 212 the operator initiates the digging operation. This can include entering a "proceed," a "dig," a "go," or other similar command on the console or operator interface (not shown) to transition from the setup steps to the operation steps. In addition, or alternatively, the digging operation can be initiated (or triggered) by operation of the arm assembly 46 and/or implement 90 (e.g., initiating rotation of the auger 110 by initiating operation of the auger drive assembly 106, etc.).

Next, the system 200 calculates the position and the orientation of the implement 90 relative to the surface 38 (or ground 38), which occurs at step 216. The position and orientation calculation can include at least one calculation, and as illustrated, a plurality of calculations. The number of calculations depends upon factors such as the number and type of sensors, the type of vehicle, and/or the type of arm assembly 46 (e.g., dual boom arms 50, 54, a single boom arm defined by a plurality of sequential linkages that can extend and/or retract—such as in an excavator or a backhoe, etc.).

As shown in FIG. 5, at step 220 the system calculates the orientation of the vehicle 10 relative to the surface 34 (or ground 34). This can include measuring the orientation of the vehicle 10 as detected by the inertial measurement unit 142. More specifically, the roll of the vehicle 10, or the distance the vehicle 10 rotates around the X-axis (shown in FIG. 4) is detected. In addition, the pitch of the vehicle 10, or the distance the vehicle 10 rotates around the Y-axis (shown in FIG. 4) is detected. This orientation of the vehicle 10, which is representative of the terrain 34 (or surface 34) upon which the vehicle 10 is operating, is used to determine the orientation of the implement 90 (e.g., the orientation of the auger 110 relative to the surface 34, etc.). If the orientation is determined to be angled to the surface 34, or not aligned with the direction of the hole to be dug, the system 200 can provide the operator feedback to guide realignment of the implement 90 (e.g., the auger 110, etc.). The feedback can be continuous and real time to facilitate adjustment (or realignment) of the vehicle 10 to achieve a desired orientation of the implement 90 (e.g., the auger 110, etc.).

At step 224, the system calculates an initial position of the implement 90 relative to the vehicle 10. More specifically, the position of the implement 90 is detected through the implement position sensor assembly. One or more of the cylinder position sensors 130, 134, and/or one or more pin rotation sensors 138 are used to detect a position of the arm assembly 46 relative to the vehicle 10. This position is established as an initial implement position. The arm assembly 46 can be in any suitable position or orientation relative to the vehicle 10 for the initial position, as the system 200 is preprogrammed with the various positions of the arm assembly 46 and associated measurements of the sensors 130, 134, 138. The system 200 then utilizes the implement offset distance entered in step 208, with the initial position of the arm assembly 46, to calculate an initial position of the implement 90 relative to the vehicle (e.g., an initial position of the auger 110 relative to the vehicle 10, an initial position of the auger 110 relative to the ground 34, etc.). It should be appreciated that steps 220-224 can occur concurrently, or can occur in reverse order. In other embodiments, any suitable steps to determine the position of the implement 90 (e.g., the auger 110, etc.) relative to the vehicle 10 to establish an initial position of the implement 90 can be implemented.

At step 228, the system proceeds to begin digging. Digging can begin by the operator moving the arm assembly 46, and as such moving the implement 90 (e.g., the auger 110, etc.) towards the surface 34, eventually contacting the surface 34. Following contact, the implement 90 digs into the surface 34 (or ground 34).

As digging is underway, and the implement 90 is lowered towards the surface 34 (or ground 34), the system proceeds to step 232 and recalculates the position of the implement 90 (e.g., the auger 110, etc.) relative to the vehicle 10. The recalculation of the position of the implement 90 relative to the vehicle 10 is essentially the same analysis as occurs at step 224.

At step 236, the recalculated position of the implement 90 relative to the vehicle 10 is analyzed to determine if the target depth D into the surface 34 has been reached. More specifically, the system 200 uses the targeted depth D (entered in step 204) and the offset distance for the implement 90 from the control point entered in step 208 (e.g., the auger length 122, etc.) to calculate a final implement position relative to the vehicle 10 realized when a portion of the implement 90 reaches the targeted depth D into the surface (or targeted depth D of the dig into the surface). It should be appreciated that the portion of the implement 90 that reaches the targeted depth D into the surface can be any portion of the implement 90. For example, any portion of the implement 90 can include the auger tip 114, a lowest portion of a bucket extending into the surface 34 during an excavation digging cycle, or any other suitable portion of the implement 90 that extends into the surface 34 and that is representative of reaching the targeted depth D. The final implement position is the position of the arm assembly 46 and/or the position of the implement 90 relative to the vehicle 10 associated with reaching the targeted depth D into the surface. The system then compares the recalculated position of the implement relative to the vehicle 10 from step 232 with the final implement position (or the position of the arm assembly 46 (or position of the implement 90 relative to the vehicle 10) associated with the targeted depth D. If the system determines that the recalculated position of the implement relative to the vehicle 10 from step 232 has not reached the final implement position (the position of the arm assembly 46 or position of the implement 90 relative to the vehicle 10) associated with the targeted depth D, or determines "no," the system returns to step 232, the digging process continues, and steps 232-236 repeat. If the system determines that the recalculated position of the implement relative to the vehicle 10 from step 232 has reached the final implement position (the position of the arm assembly 46 or position of the implement 90 relative to the vehicle 10) associated with the targeted depth D, or determines "yes," the process proceeds to step 240. A determination of "yes" also indicates that the implement 90 (or any portion thereof)

has reached the targeted depth D (entered in step 204), meaning the digging operation has achieved the targeted depth without over digging.

Next, at step 240 the system provides notification to the operator that the targeted depth D has been reached. The notification can include an audible sound or notification, a visual notification, and/or any other suitable notification to indicate to the operator that the targeted depth D has been reached. This notification can provide an instruction to the operator to stop the digging process (e.g., terminate operation of the implement 90, terminate operation of the auger 110, etc.).

Further, in some embodiments of the system 200 can automatically control the depth of digging to limit over digging. In these embodiments, digging and the associated steps 212 to 240 occur automatically, or without operator intervention. Stated another way, the digging will occur without operator involvement, and is fully automatic. Once step 240 is achieved, the system 200 can also (or alternatively) terminate operation of the implement 90 (e.g., stop operation of the auger 110, etc.).

In addition, some embodiment of the system 200 can be integrated with the vehicle location sensor 126 (or the GPS receiver 126). The GPS receiver 126 can be used to direct the vehicle 10 to a specific geographic location (or a desired geographic location) in an area of the surface 34 for digging. As such, the operator and/or the system 200 can utilize the GPS receiver 126 to identify a specific geographic location for digging, direct the vehicle to the specific geographic location for digging, and then dig at the specific geographic location.

The vehicle 10 and the associated system 200 disclosed herein has certain advantages. Notably, the system 200 can accurately dig to a targeted (or desired) depth to limit undesirable over digging. Over digging results in lost time involved in backfilling and compacting the dug area with additional material to decrease the depth of the dig. Accordingly, limiting over digging improves digging efficiency and decreases the total time investment during digging by limiting remediation. Various additional features and advantages of the disclosure are set forth herein.

What is claimed is:

1. A grade management system comprising:

a vehicle including an arm assembly coupled to an implement, the implement configured to dig into a surface;

an implement position sensor coupled to the arm assembly, the implement position sensor configured to detect a position of the implement relative to the vehicle; and a control system in communication with the implement position sensor and configured to 1) determine a calculated position of the implement relative to the vehicle representative of a targeted depth into the surface, 2) in response to digging into the surface with the implement, detect the position of the implement relative to the vehicle, and 3) compare the detected position to the calculated position to determine whether any portion of the implement reaches the targeted depth.

2. The grade management system of claim 1, wherein the implement includes an auger.

3. The grade management system of claim 2, wherein the auger defines an auger length used to detect the position of the auger relative to the vehicle.

4. The grade management system of claim 1, wherein the vehicle is one of a compact track loader or a skid steer.

5. The grade management system of claim 1, wherein the implement position sensor assembly includes at least one of a cylinder position sensor, a pin rotation sensor, or an inertial measurement unit.

6. The grade management system of claim 1, wherein the control system is configured to, in response to the detected position of the implement relative to the vehicle corresponding to the targeted depth into the surface, terminate operation of the implement.

7. The grade management system of claim 1, wherein the control system is configured to, in response to the detected position of the implement relative to the vehicle corresponding to the targeted depth into the surface, initiate an audible notification or visual notification that indicates the targeted depth into the surface has been reached.

8. A method of controlling a depth of a dig into a surface with a vehicle, the method comprising:

selecting a target depth of the dig into the surface;

detecting a position of an implement relative to the vehicle;

using the detected position of the implement relative to the vehicle to assign an initial implement position;

determining the distance from the initial implement position to the ground;

determining a final implement position based on at least a position of the implement relative to the vehicle upon reaching the target depth of the dig into the surface;

initiating digging with the implement;

monitoring the position of the implement relative to the vehicle during digging; and determining whether the detected position of the implement relative to the vehicle corresponds to the final implement position.

9. The method of claim 8, wherein the vehicle is one of a compact track loader or a skid steer.

10. The method of claim 8, wherein the implement is an auger attachment including an auger.

11. The method of claim 10, wherein the auger includes an auger length used in determining the distance from the initial implement position to the ground and the final implement position.

12. The method of claim 8, further comprising detecting an orientation of the vehicle relative to the surface; and using the detected orientation of the vehicle relative to the surface to assign an initial implement position.

13. The method of claim 12, further comprising:

detecting an orientation of the vehicle relative to the surface with at least one inertial measurement unit.

14. The method of claim 8, further comprising an implement position sensor configured for detecting the position of the implement relative to the vehicle.

15. The method of claim 14, wherein the implement position sensor includes at least one of a cylinder position sensor, a pin rotation sensor, or an inertial measurement unit.

16. The method of claim 8, further comprising determining the distance from the initial implement position to the ground based in part by an offset distance of the implement.

17. The method of claim 8, wherein in response to the detected position of the implement relative to the vehicle corresponds to the final implement position, terminating operation of the implement.

18. The method of claim 8, wherein in response to the detected position of the implement relative to the vehicle corresponds to the final implement position, emitting a signal indicating the target depth of the dig into the surface has been achieved.

19. The method of claim 18, wherein emitting a signal indicating the target depth of the dig into the surface has been achieved includes emitting an audible signal, emitting a visual signal, or terminating operation of the implement.

* * * * *